US010392818B2

(12) United States Patent
Gruebler

(10) Patent No.: US 10,392,818 B2
(45) Date of Patent: Aug. 27, 2019

(54) CLIMBING FORMWORK FOR ERECTING A CONCRETE STRUCTURE

(71) Applicant: DOKA GMBH, Amstetten (AT)

(72) Inventor: Stefan Gruebler, Amstetten (AT)

(73) Assignee: DOKA GMBH, Amstetten (AT)

( * ) Notice: Subject to any disclaimer, the term of this patent is extended or adjusted under 35 U.S.C. 154(b) by 0 days.

(21) Appl. No.: 16/031,838

(22) Filed: Jul. 10, 2018

(65) Prior Publication Data

US 2018/0320392 A1 Nov. 8, 2018

Related U.S. Application Data

(63) Continuation of application No. 15/442,331, filed on Feb. 24, 2017, now Pat. No. 10,077,564.

(51) Int. Cl.

| | |
|---|---|
| ***E04G 11/28*** | (2006.01) |
| ***E04G 11/24*** | (2006.01) |
| ***E04B 1/16*** | (2006.01) |
| ***E04B 1/35*** | (2006.01) |
| ***E04G 17/00*** | (2006.01) |
| ***E04G 19/00*** | (2006.01) |

(52) U.S. Cl.

CPC ..... *E04G 11/28* (2013.01); *E04B 1/161* (2013.01); *E04B 1/35* (2013.01); *E04G 11/24* (2013.01); *E04G 17/002* (2013.01); *E04G 19/003* (2013.01)

(58) Field of Classification Search

CPC ..... E04G 11/28; E04G 11/22; E04G 11/30; E04G 11/24

USPC ..... 425/63, 65; 249/20, 27

See application file for complete search history.

(56) References Cited

U.S. PATENT DOCUMENTS

| | | | |
|---|---|---|---|
| 3,920,780 | A | 11/1975 | Vanderklaauw |
| 4,076,778 | A | 2/1978 | Whitting |
| 5,263,835 | A | 11/1993 | Schmidt |

(Continued)

FOREIGN PATENT DOCUMENTS

| | | | |
|---|---|---|---|
| DE | 871960 | C | 10/1951 |
| GB | 917314 | A | 2/1963 |

(Continued)

OTHER PUBLICATIONS

ISA European Patent Office, International Search Report and Written Opinion Issued in Application No. PCT/EP2018/054455, dated May 18, 2018, WIPO, 12 pages.

*Primary Examiner* — Michael Safavi

(74) *Attorney, Agent, or Firm* — McCoy Russell LLP

(57) ABSTRACT

A method for erecting a concrete structure by successively casting at least a first casting segment with a first floor slab, a second casting segment with a second floor slab and a third casting segment with a third floor slab includes providing a support column carrying a frame for suspending a formwork therefrom, the support column having a jack for transferring the support column from a retracted position to an extended position and vice versa, supporting the support column, by means of a first support bracket, arranging a second support bracket, at a vertical position between the second and third floor slab, on the support column, activating the jack for transferring the support column from the retracted position to the extended position, supporting the support column, by means of the second support bracket, and activating the jack for transferring the support column from the extended position to the retracted position.

17 Claims, 20 Drawing Sheets

(56) References Cited

U.S. PATENT DOCUMENTS

| | | | |
|---|---|---|---|
| 5,460,499 | A | 10/1995 | Franklin |
| 6,276,912 | B1 | 8/2001 | Röck |
| 2002/0030293 | A1 | 3/2002 | Rock |
| 2008/0257644 | A1 | 10/2008 | Schwoerer |
| 2014/0175259 | A1 | 6/2014 | Baum |

FOREIGN PATENT DOCUMENTS

| | | | |
|---|---|---|---|
| JP | S5316430 | A | 2/1978 |
| WO | 9009497 | A1 | 8/1990 |
| WO | 2005042876 | A1 | 5/2005 |
| WO | 2007000134 | A1 | 1/2007 |

CLIMBING FORMWORK FOR ERECTING A CONCRETE STRUCTURE

CROSS-REFERENCE TO RELATED APPLICATIONS

The present application is a continuation of U.S. application Ser. No. 15/442,331 entitled "METHOD FOR ERECTING A CONCRETE STRUCTURE AND CLIMBING FORMWORK," filed on Feb. 24, 2017, the entire contents of the above-identified application is hereby incorporated by reference in its entirety for all purposes.

TECHNICAL FIELD

The present disclosure relates generally to the erection of concrete structures, such as high-rise buildings, utilizing climbing formworks.

DESCRIPTION OF THE RELATED ART

In the prior art, a great variety of formworks has been proposed. Such formworks, also known as shuttering, are temporary retaining structures for defining and supporting a volume to be filled with concrete. As is well known in the prior art, climbing formworks are used for transferring the loads resulting from the present casting step into previously formed casting segments. In this way, concrete-structures such as high-rise buildings can be erected without the need for scaffolding extending the full height of the construction. Such climbing formworks are successively raised and secured to the concrete structure, which procedure is repeated after each casting step.

A climbing formwork was proposed, for example, in U.S. Pat. No. 5,263,835. In this prior art, a building construction system is used for progressively forming a plurality of vertical superimposed concrete segments. A plurality of screw jacks form support columns and carry at their upper ends sub-frames upon which an overlying main frame is positioned. Formworks are suspended from the main frame and are moveable into position for pouring concrete to form the segments. The screw jacks are supported on a horizontal building element preceding a previously constructed horizontal building element and are retractable. The main frame is supported on adjustable struts for repositioning the screw jacks prior to extension to a subsequent segment forming position. It is a drawback of this prior art that temporary supports, namely said adjustable struts, are required for supporting the main frame while repositioning the screw jacks. In this way, the temporary supports may have to be manually transported to the next level for preparation of the subsequent casting step. Furthermore, the attachment of the temporary supports on the sub-frames supporting the main frame is cumbersome.

The object of the disclosure is to provide a method and climbing formwork mitigating the drawbacks of the prior art. The disclosure particularly aims at improving the repositioning of the climbing formwork between two casting steps.

SUMMARY OF THE INVENTION

In one embodiment, the present disclosure provides for a method for erecting a concrete structure by successively casting at least a first casting segment with a first floor slab, a second casting segment with a second floor slab and a third casting segment with a third floor slab, said method comprising the steps of:

- providing a first, second and third through-hole in the first, second and third floor slab of the first, second and third casting segment, respectively,
- providing a support column carrying, at an upper end thereof, a frame for suspending a formwork therefrom, the support column having a jack for transferring the support column from a retracted position to an extended position and vice versa,
- supporting the support column, by means of a first support bracket, on the first floor slab adjacent to the first through-hole,
- arranging a second support bracket, at a vertical position between the second and third floor slab, on the support column,
- activating the jack for transferring the support column from the retracted position to the extended position, thereby passing the second support bracket through the third through-hole in the third floor slab,
- supporting the support column, by means of the second support bracket, on the third floor slab adjacent to the third through-hole,
- activating the jack for transferring the support column from the extended position to the retracted position, thereby passing the first support bracket through the second through-hole in the second floor slab.

Thus, the method utilizes a climbing formwork with a generally vertically extending support column, which, in different stages of the climbing operation, is supported either on the first support bracket, namely during extension of the support column between two casting steps, or on the second support bracket, namely during the casting steps and during the retraction of the support column. In this operation, the first and second support bracket are supported on the respective floor slabs, immediately adjacent to through-holes previously been formed therein. It is thus not required to support the frame holding the formworks exclusively by means of temporary supports during retraction of the support column. Of course, additional supports for the frame could be used, depending on the application. It is a further advantage of the method proposed herein that the first and second support bracket is transported upwards together with the support column during repositioning of the climbing formwork. Thus, the method does not require the manual transport of temporary supports for the support column as in the prior art.

In one example, at least during extension of the support column, two first support brackets are attached to the same support column on opposite sides thereof. The two first support brackets may be arranged at the same vertical position on the support column.

In another example, at least during retraction of the support column, two second support brackets are attached to the same support column on opposite sides thereof. The two second support brackets may be arranged at the same vertical position on the support column.

In this method, the first and second support bracket may be supported on the respective floor slab immediately adjacent to the through-hole, i.e. on an edge of the through-hole.

In one embodiment, the first and/or second support bracket, in the first or second support position, respectively, extends radially outwards with respect to the (vertically extending) longitudinal axis of the support column.

In another embodiment, the first and/or second support bracket each has an upper side facing away from the underlying floor slab and a lower side facing the underlying floor slab for support thereon, wherein the radial extension of the upper side of the first and/or second support bracket is less than, for example less than one half of, the radial extension of the lower side of the first or second support bracket, respectively. Thus, in side view, the first and/or second support bracket may have an angular shape widening towards the floor slab. This construction combines low weight with effective load transfer into the floor slab.

The method proposed herein may be used in a number of applications, in which at least one, a plurality of support columns as described herein supports the frame carrying the formworks.

For example, a number of such support columns may be employed outside the core of high-rise buildings for supporting a frame superimposing essentially the full horizontal extension of the construction as built. In this application, additional, for example conventional, climbing formworks may be provided in the core of the building.

In another example, a plurality of such support columns are arranged outside the core of the building for superimposing the core of the building which may then be free from additional climbing formworks.

In yet another example, such support columns are employed for supporting floor slabs between two rows of shafts on either side of the floor slabs. Additional support columns may be arranged outside the core.

In one embodiment, the support column, by means of the second support bracket, is supported on the second floor slab adjacent to the second through-hole during casting of the third casting segment. In this way, the second support bracket is arranged for receiving vertical loads during a casting step. These vertical loads include not only the weight of the support column, the frame and the formworks suspended therefrom but also the weight of the concrete received in the cavity between the formworks (shuttering). On the other hand, the first support bracket is arranged for transferring the vertical loads during lifting of the support column together with the frame and the formworks. The first support bracket on the lower end of the support column may receive lesser vertical loads than the second support bracket.

In another embodiment, the first support bracket is releasably attached to the support column in a first support position for being supported on the first floor slab adjacent to the first through-hole while the support column is transferred from the retracted position to the extended position and wherein the first support bracket is released from the support column and then releasably attached to the support column in a first transport position for being passed through the second through-hole while the support column is transferred from the extended position to the retracted position. In this embodiment, the first support bracket may be manually repositioned from the first support position, which is arranged for transferring vertical loads into the respective floor slab, to the first transport position, which is arranged for allowing passage of the first support bracket through the through-hole in the respective floor slab. The advantage of this embodiment is that the first support bracket need not be carried to the next floor when the climbing formwork is repositioned. In the first transport position, the first support bracket is transported upwards together with the support column. In other words, the support column may be used as an elevator for transporting the first support bracket during a climbing step of the climbing formwork.

In one embodiment, the first support bracket in the first support position and/or in the first transport position is releasably attached to a bearing, the bearing being connected to a lower end of the jack. The support column may comprise a mast with an upper end carrying the frame which may have a number of sub-frames, for example cross-beams from which the formworks are suspended. The jack is operably connected to the mast for extending or retracting the support column (i.e. for increasing or decreasing the distance between the upper end of the mast and the bearing on the lower end of the support column). In one example, a vertical extension of the first support bracket is less than the vertical extension of the bearing. In this way, an optimal load transfer from the bearing at the lower end of the support column via the first support bracket, arranged in the first support position, to the first floor slab is achieved.

In one embodiment, the first support bracket, in the first transport position, is arranged upside-down. In the upside-down transport position, the first support bracket fits through the through-holes in the floor slabs.

In one embodiment, the second support bracket is releasably attached to the support column in a second transport position for being passed through the third through-hole while the support column is transferred from the retracted position to the extended position and wherein the second support bracket is released from the support column and then releasably attached to the support column in a second support position for being supported on the third floor slab adjacent to the third through-hole while the support column is transferred from the extended position to the retracted position. Thus, the second support bracket may be manually transferrable between the second support position, which is arranged for providing vertical support on the respective floor slab, and the second transport position, which is arranged for allowing passage of the second support bracket through the through-hole of the overlying floor slab. The support column may have an attachment member, for example an attachment pin, for securing the second support bracket in the second transport position.

In one example, the second support bracket is identical to the first support bracket. But the overall construction of the support column may be such that only the second support position of the second support bracket, not the first support position of the first support bracket is adapted for the higher vertical loads during the casting steps.

In an embodiment, the second support bracket, in the second support position, is releasably attached to the support column at one of a plurality of vertically spaced attachment locations. This embodiment allows for great adaptability and flexibility, in particular for the construction of buildings with complex geometries.

In an embodiment, the second support bracket, in the second support position, is releasably attached to a flange of the support column, the flange having a plurality of vertically spaced attachment openings for securing the second support bracket thereto. The second support bracket may have apertures corresponding to the attachment openings in the flange. Bolt members, for example, may be used to secure the second support bracket to the flange of the support column.

In an embodiment, the second transport position is perpendicular to the second support position. In this way, the second transport position allows for stowing of the second support bracket for transport to the next level of the concrete structure during extension of the support column.

In an embodiment, a first gravity pawl is used as the first support bracket and/or a second gravity pawl is used as the second support bracket. In this embodiment, the first and/or second gravity pawl is pivotable between a normal position for support on the underlying floor slab and a temporary position for transport through the through-hole of the overlying floor slab. In the normal position, a support area of the first or second gravity pawl may extend generally horizontally. In the temporary position, the support area may be pivoted inwardly. Advantageously, this embodiment dispenses with the requirement of manual repositioning of the first and/or second gravity pawl during a climbing step.

In an embodiment, the first support bracket is supported on the first floor slab via a first floor frame arranged adjacent to the first through-hole.

In an embodiment, the second support bracket is supported on the second floor slab via a second floor frame arranged adjacent to the second through-hole.

In an embodiment, the second support bracket is supported on the third floor slab via a third floor frame arranged adjacent to the third through-hole.

The arrangement of the first, second and/or third floor frame supports the transfer of the vertical loads into the respective floor slab. In one example, the first, second and/or third floor frame is made from a metal material, for example steel.

In an embodiment, the first floor frame and/or the second floor frame and/or the third floor frame comprises two separate frame parts. The two-part construction of the floor frames facilitates removal of the respective floor frame for preparation of a climbing step. This embodiment further allows for easy adaptation to different sizes of the through-holes.

In an embodiment, the two separately removable frame parts are L-shaped in top view. This construction provides a sufficiently large surface for supporting the first or second support bracket thereon. Furthermore, additional components, such as guide elements for the support column, may be arranged on the floor frame.

In an embodiment, the support column, while being transferred from the retracted position to the extended position or vice versa, is guided and horizontally supported. For this purpose, guide elements such as rolls may be arranged on the floor frames that provide support, in particular rolling support, for the support column.

In an embodiment, a climbing formwork for erecting a concrete structure with a plurality of casting segments having floor slabs with through-holes formed therein, comprises:

- a support column with a jack for transferring the support column between a retracted position and an extended position;
- a frame connected to the support column for suspending a formwork;
- a support bracket attached to the support column,
- wherein the support bracket is transferable between a support position for being supported on one of the floor slabs and a transport position for being passed through one of the through-holes in the floor slabs.

In another embodiment, a climbing formwork for erecting a concrete structure with a plurality of casting segments having floor slabs with through-holes formed therein, comprises:

- a support column with a jack for transferring the support column between a retracted position and an extended position;
- a frame connected to the support column for suspending a formwork;
- a support bracket attached to the support column,
- wherein at least one of the support brackets comprises a gravity pawl arranged for being passed through one of the through-holes in the floor slabs and for being supported on the respective floor slab adjacent to the through-hole.

BRIEF DESCRIPTION OF THE DRAWINGS

Embodiments of the disclosure will be described with reference to the accompanying drawings.

DETAILED DESCRIPTION

Figure 1:
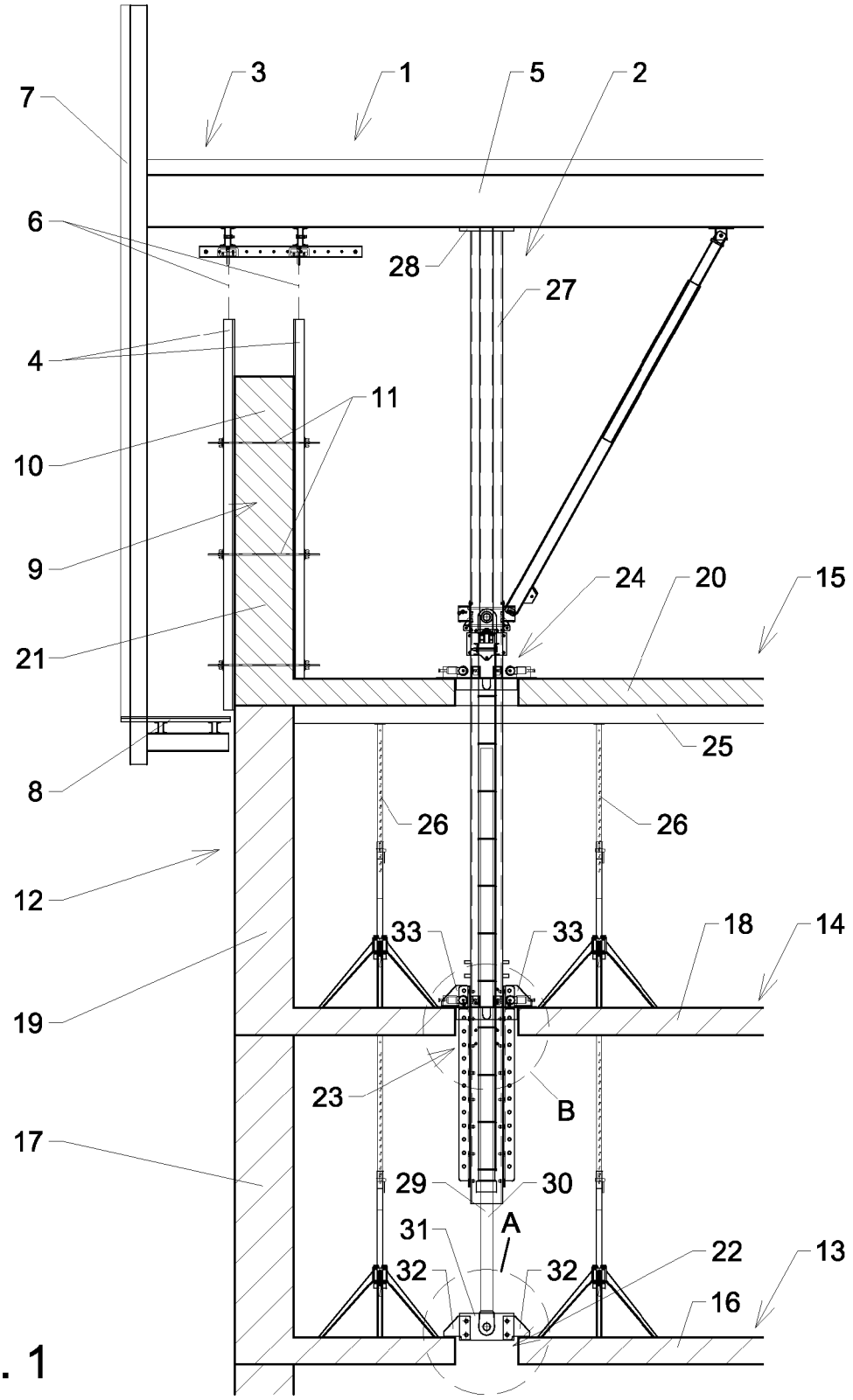
FIG. 1 is a side elevational view of a climbing formwork with an extendible support column for the progressive formation of a concrete structure with a first, second, third and fourth casting segment, in which the climbing formwork is shown in a first stage of repositioning the climbing formwork for preparation of a subsequent casting step.

Referring to FIGS. 1 to 5 of the drawings, a first embodiment of the disclosure relates to a climbing formwork 1 with a (generally vertically extending) support column 2, a frame 3 and formworks 4. In the shown embodiment, frame 3 has a cross-beam 5 from which the formworks (for example sheathings) 4 are suspended (as illustrated by lines 6 in FIG. 1 and FIG. 2). In this embodiment, a single leg support column 2 is used. Thus, the support column 2 is not rigidly connected to another support column 2 by means other than the frame 3. It is apparent that frame 3 may comprise a number of other known frame components, such as a vertical frame member 7 carrying a working platform 8. As is well known in the prior art, the formworks 4 delimit a cavity 9 for receiving concrete 10 therebetween. Furthermore, anchors 11 may be arranged for holding the formworks 4 together during casting. In the shown example, the climbing formwork 1 is used for constructing a concrete structure 12, for example a high-rise building, with superimposed first casting segment 13, second casting segment 14 and third casting segment 15. In one example, the third casting segment 15 is directly above the second casting segment 14 which itself is directly above the first casting segment 13. However, additional casting segments may be present between the first and second casting segment or between the second and third casting segment (not shown). In this case, the dimensions of the climbing formwork 1 have to be adapted accordingly.

FIG. 1 shows the formation of the third casting segment 15 on top of the first casting segment 13 and the second casting segment 14 that were formed in previous casting steps. In this way, the building 12 is progressively erected in a plurality of distinct casting steps. In the shown example, the first casting segment 13 has a first floor slab 16 and first wall 17. Likewise the second casting segment 14 has a second floor slab 18 and a second wall 19. The third casting segment 15 has a third floor slab 20 and a third wall 21. The first floor slab 16, second floor slab 18 and third floor slab 20 generally extend in horizontal direction, while the first wall 17, second wall 19 and third wall 21 generally extend in vertical direction. However, it is apparent that the first wall 17, second wall 19 and third wall 21 could be inclined, depending on the geometry of the building 12. A first through-hole 22 is formed in the first casting segment 13, a second through-hole 23 is formed in the second casting segment 14 and a third through-hole 24 is formed in the third floor slab 20. The first, second and third through-hole generally extend in horizontal direction. In top view, the first, second and third through hole may be rectangular.

FIG. 1 shows the climbing formwork 1 in a first stage of a climbing operation for moving the climbing formwork 1 upwards by one level for preparation of a subsequent casting step. In FIG. 1, the third casting segment 15 is formed using the formworks 4 suspended from the frame 3 mounted on the support column 2. Furthermore, FIG. 1 schematically shows a formwork member 25 for the floor slab 20. This formwork member 25 is supported from below by means of struts 26. It is apparent to the person skilled in the art that a great variety of other formworks may be present for performing the casting step (not shown).

Figure 2:
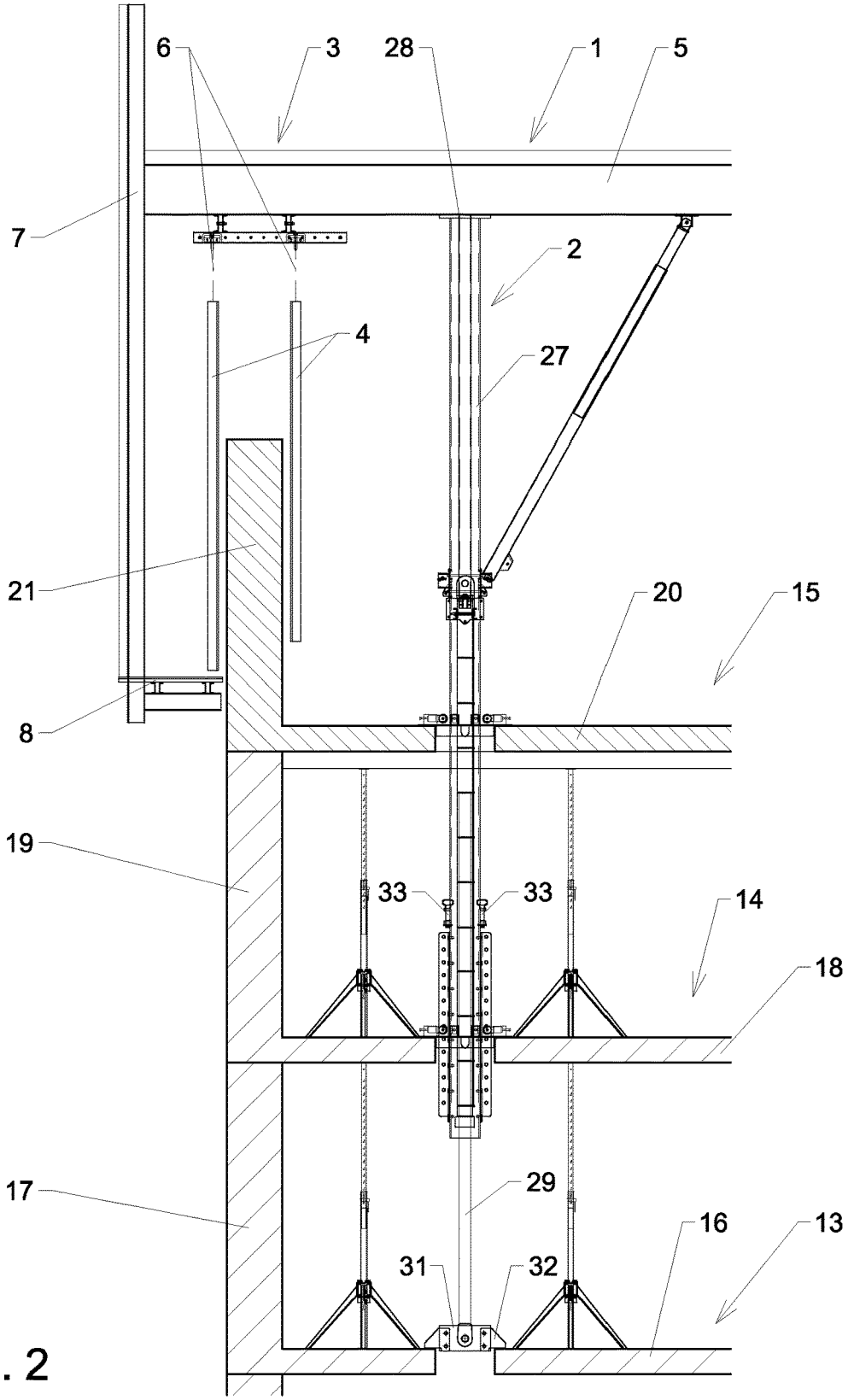
FIG. 2 is a side elevational view of the climbing formwork of FIG. 1 in a second stage of the repositioning operation.
Figure 3:
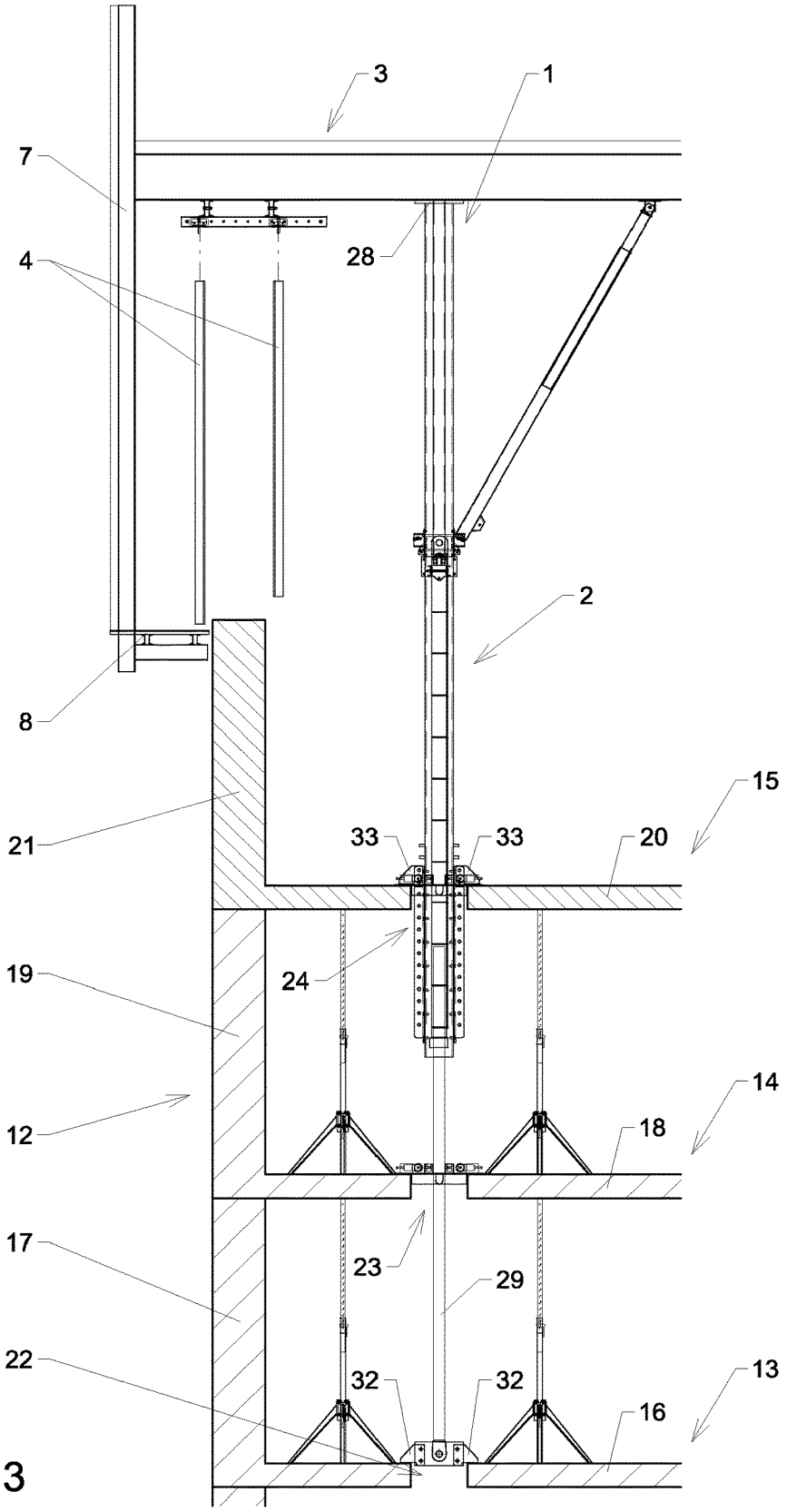
FIG. 3 is a side elevational view of the climbing formwork of FIG. 1 and FIG. 2 in a third stage of the repositioning operation.
Figure 4:
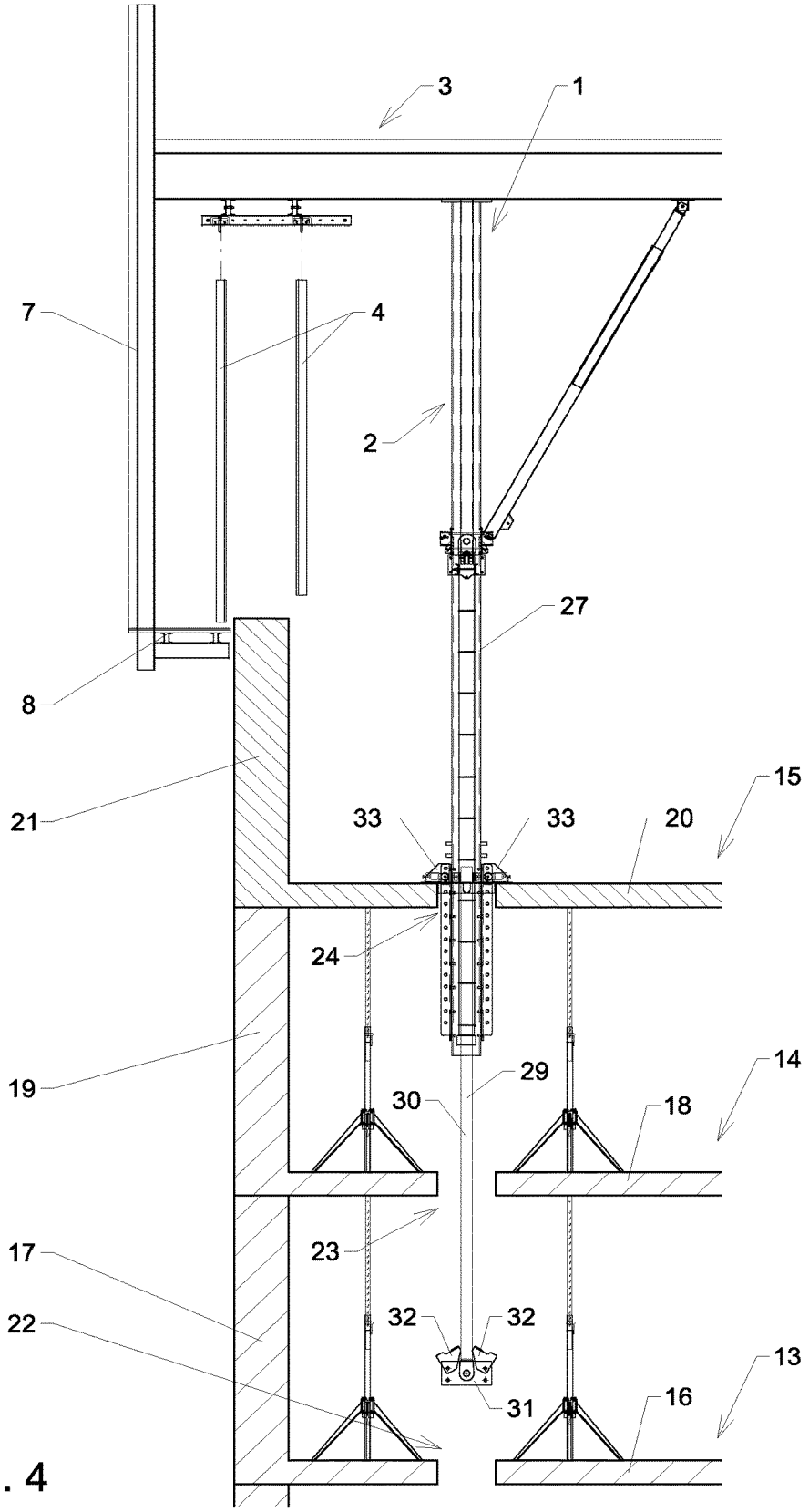
FIG. 4 is a side elevational view of the climbing formwork of FIGS. 1 to 3 in a fourth stage of the repositioning operation.
Figure 5:
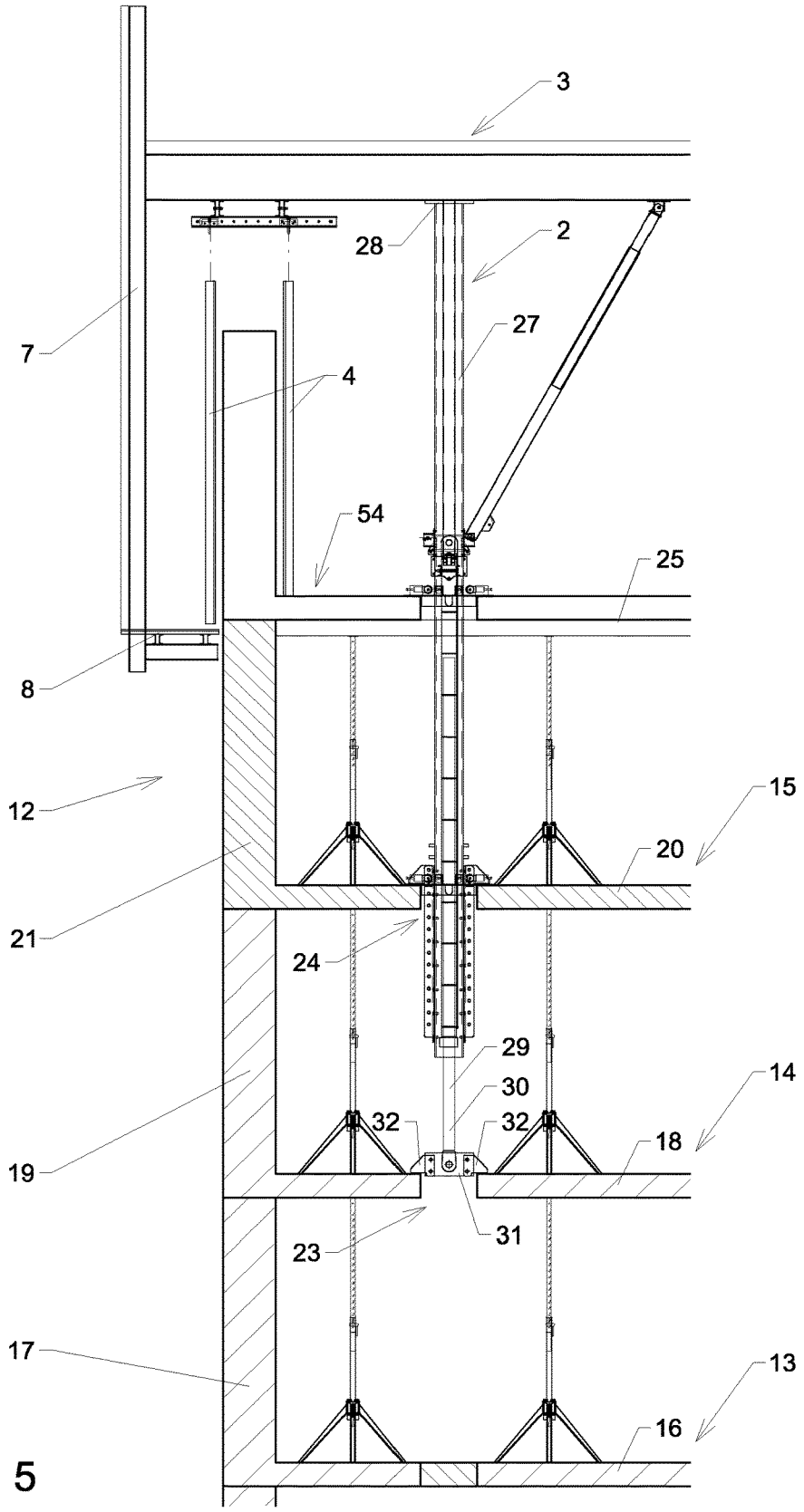
FIG. 5 is a side elevational view of the climbing formwork of FIGS. 1 to 4 in a fifth stage of the repositioning operation.

For bringing the climbing formwork 1 to the next level, the support column 1 is transferrable between a fully retracted position (shown in FIGS. 1 and 5) and a fully extended position (shown in FIG. 3) via intermediate positions (shown in FIGS. 2 and 4). For this purpose, the support column 2 has a mast 27, with an upper end plate 28 for supporting the cross-beam 5 of the frame 3, and a jack 29 attached to the mast 27. The jack 29 is arranged for lifting the mast 27 in a vertical direction. In the shown example, jack 29 comprises a piston 30, operated hydraulically, which is attached to a bearing 31. By activation of the piston 30, the distance between the bearing 31 on the lower end of the support column 2 and the upper end 28 of the support column 2 may be increased or decreased, thereby transferring the support column 2 between the retracted position and the extended position. The climbing formwork 1 further has at least one first support bracket 32, to be attached to the bearing 31 on the lower end of support column 2, and at least one second support bracket 33, to be attached to the mast 27. In the shown example, the climbing formwork 1 has two first support brackets 32 and two second support brackets 33, attached to opposite sides of the support column 2.

Utilizing this climbing formwork 1, a method for the progressive construction of the concrete structure 12 comprises at least the following successive steps, which may be repeated for formation of a plurality of superimposed casting segments:

First, the third casting segment 15 is formed on top of second casting segment 14 from the previous casting step which itself was formed on top of first casting segment 13, as explained before. During casting of the third casting segment 15, the support column 2, by means of the second support bracket 33, is supported on the second floor slab 18 directly adjacent to the second through-hole 23. The first support bracket 32 may or may not assist the support of the support column 2 during casting of the third casting segment 15 (FIG. 1). After formation of the third casting segment 15, the formworks 4 and the formwork member 25 are released from the third casting segment 15.

In the next step, the support column 2, by means of the first support bracket 32, is supported on the first floor slab 16 adjacent to (i.e. neighboring) the first through-hole 22. At this stage, the second support bracket 33 is located between the second floor slab 18 and the third floor slab 20.

In the next step, jack 29 is activated for transferring the support column 2 from the retracted position to the extended position (see FIG. 2). In this way, the mast 27 carrying the frame 3 is moved upwards. The second support bracket 33 is arranged such that it fits through the third through-hole 24 in the third floor slab during the lifting of the mast 27.

In the next step, the support column 2, by means of the second support bracket 33, is supported on the third floor slab 20 adjacent to the third through-hole 24. In this position, the formworks 4 and the formwork member 25 may be brought into casting position for casting a fourth casting segment 54 on top of third casting segment 15.

In the next step, jack 29 is activated such that support column 2 is moved from the extended position to the retracted position. During retraction of the support column 2 the first support bracket 32 is passed through the second through-hole 23 in the second floor slab 18.

In this method, the first support bracket 32 and the second support bracket 33 are transported with the support column 2. It is not required to manually carry first support bracket 32 or second support bracket 33 to the next level when the climbing formwork 1 is moved upwards. For this purpose, the first support bracket 32 and the second support bracket 33 may be temporarily re-arranged for being passed through the first through-hole 22, second through-hole 23 and third through-hole 24, as will be explained below with respect to two exemplary embodiments.

Figure 6:
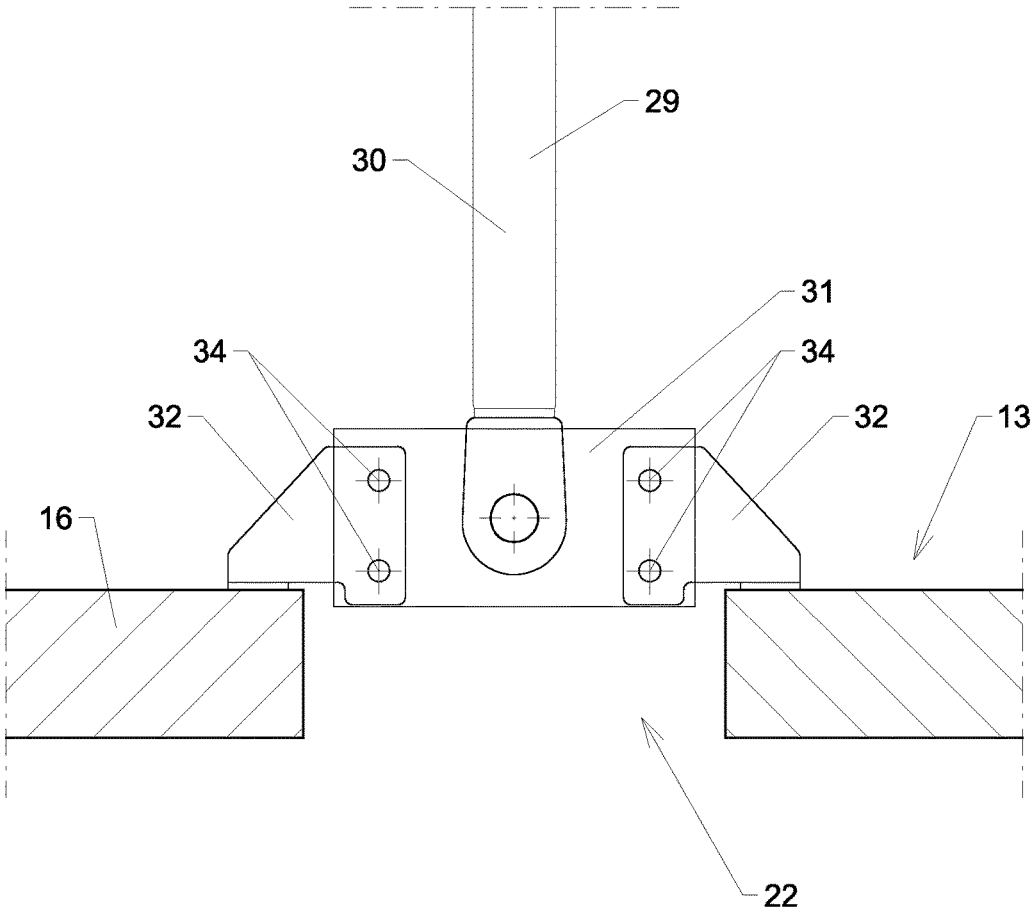
FIG. 6 shows detail A of FIG. 1.
Figure 7:
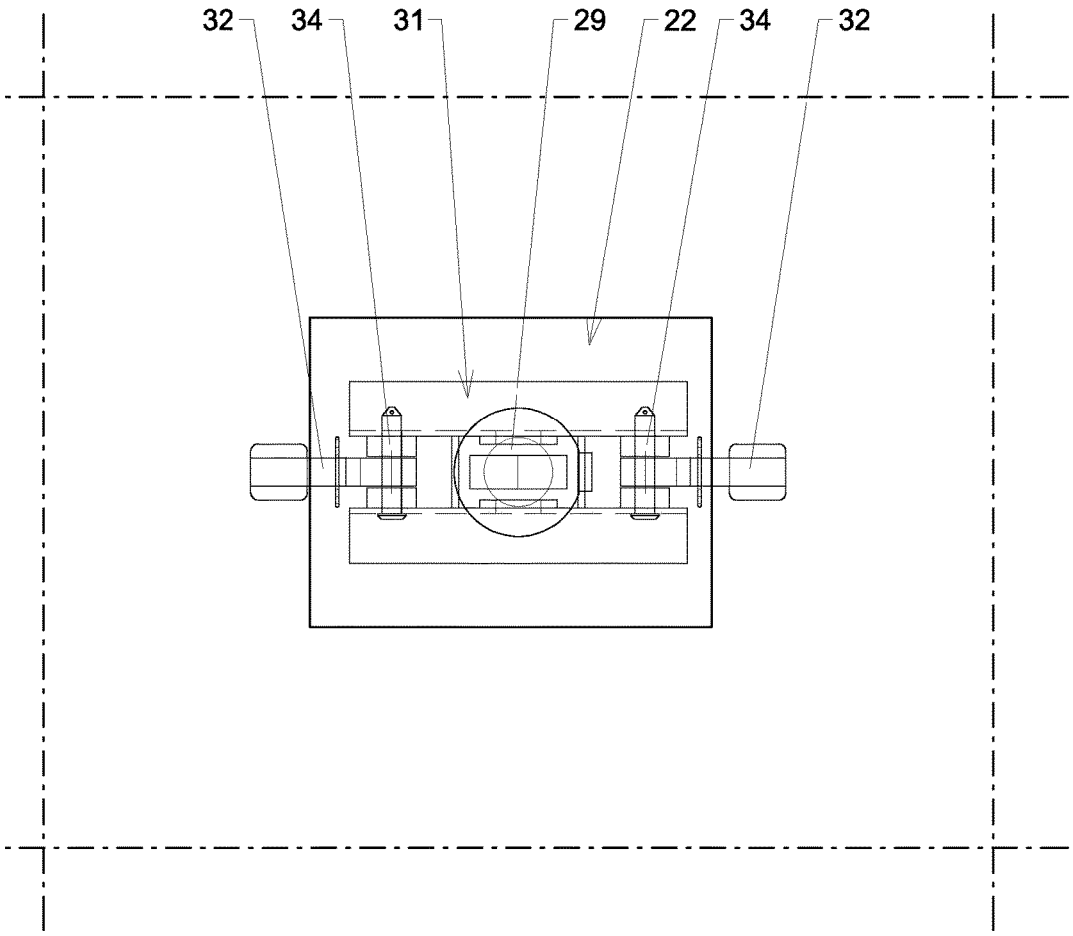
FIG. 7 is a top view of Detail A.
Figure 8:
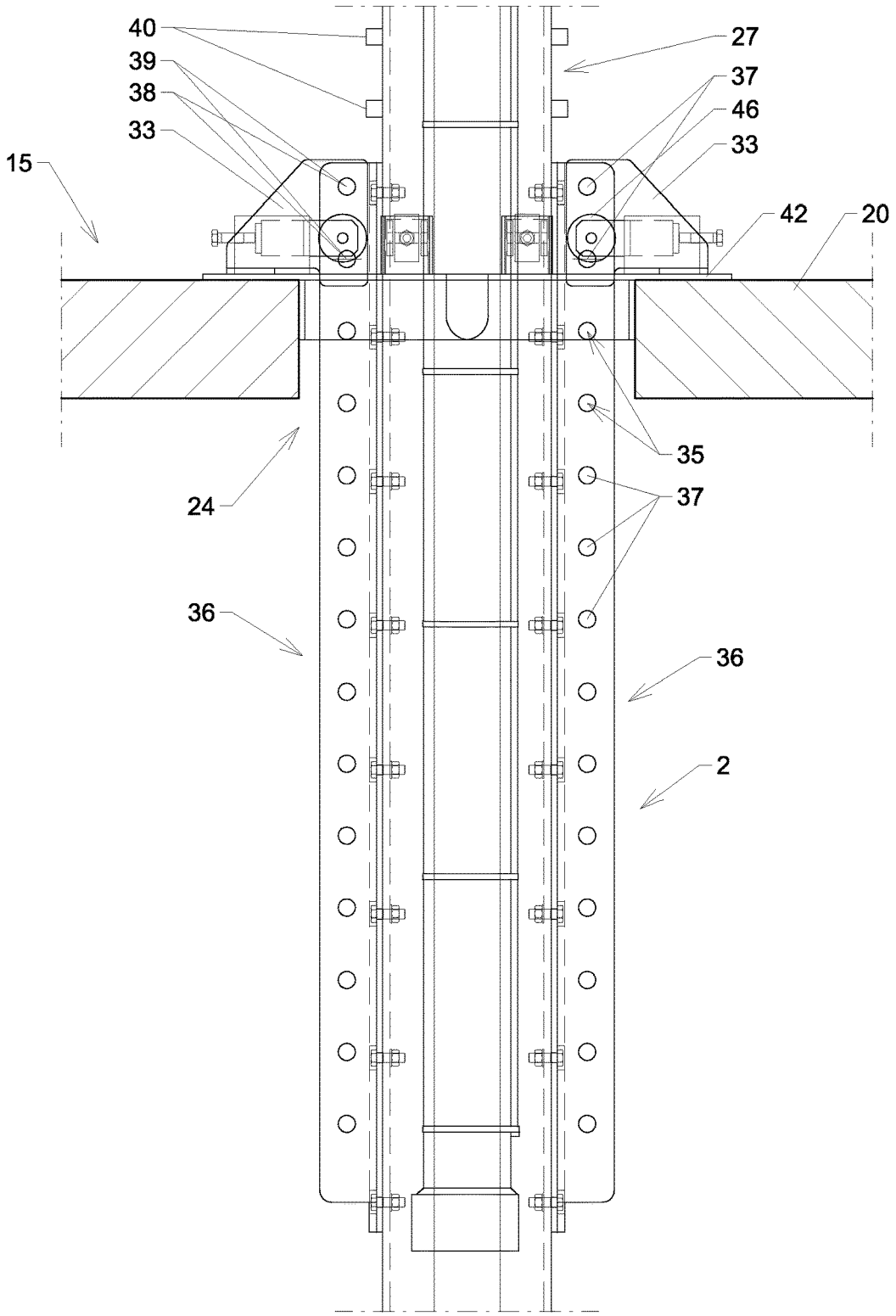
FIG. 8 shows detail B of FIG. 1.
Figure 9:
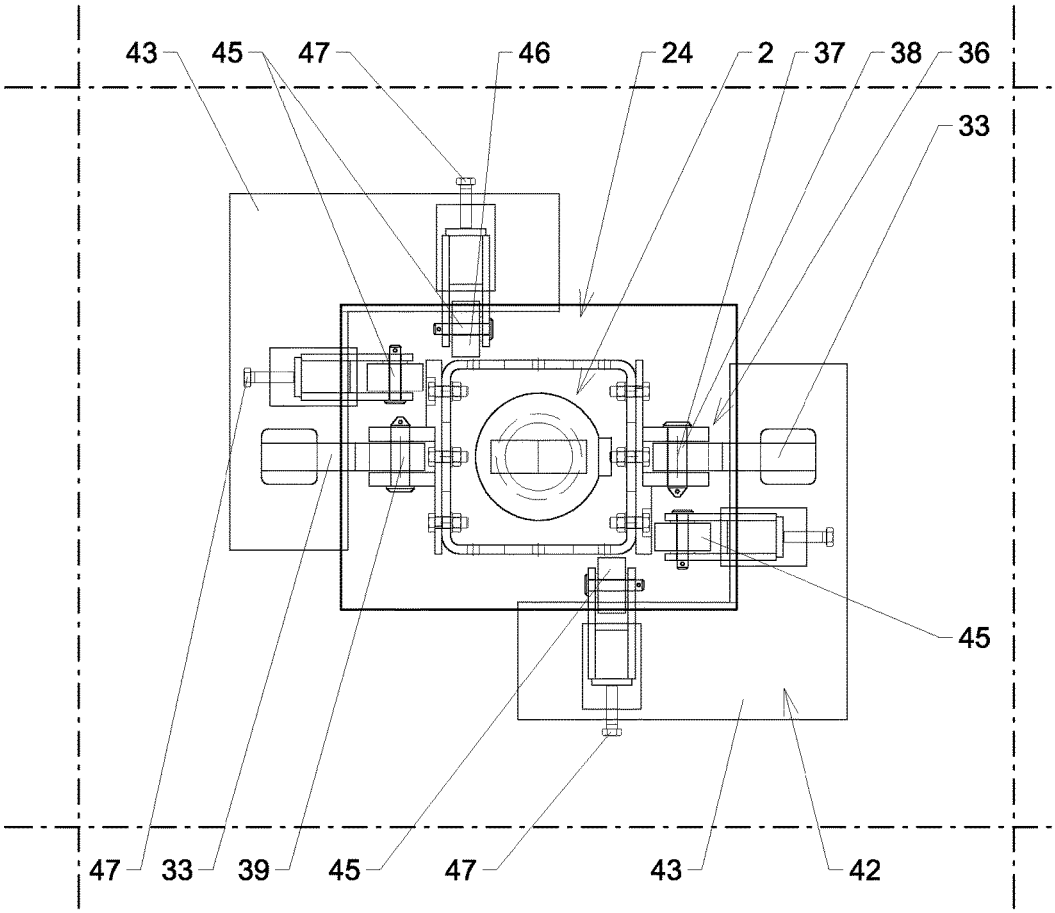
FIG. 9 is a top view of Detail B.

In the embodiment shown in FIGS. 1 to 5, shown in greater detail in FIGS. 6 to 11, the first support bracket 32 may be releasably attached to the support column 2 in a first support position for being supported on the first floor slab 13 adjacent to the first through-hole 22 while the support column 2 is transferred from the retracted position to the extended position (see FIG. 6). In the first support position, the first support bracket 32 is arranged for transferring vertical loads from the support column 2 into the first floor slab 16 (or, in a subsequent stage of the building process, into any of the superimposed floor slabs). In the shown example, bolts 34 are used for securing the first support brackets 32 to the bearing 31 in the first support position. For preparing the retraction of the support column 2, the first support brackets 32 are first removed from the bearing 31 by releasing the bolts 34. The first support brackets 32 are then releasably attached to the support column 2 in a first transport position as shown in FIG. 4. In the first transport position, the first support brackets 32 are closer to a center line of the support column 2 such that the first support brackets 32 fit through the second through-hole 23 when the support column 2 is transferred from the extended position to the retracted position. In the shown example, the first support brackets 32, in the first transport position, are arranged upside-down.

Furthermore, in the embodiment of FIGS. 1 to 11, the second support brackets 33 are releasably attached to the support column 2 in a second support position for being supported on the third floor slab 20 adjacent to the third through-hole 24 while the support column 2 is transferred from the extended position to the retracted position. In the same fashion, the second support brackets 33 are arranged in the second support position for being supported on the second floor slab 18 during casting of the third casting segment 15. In the second support position, the second support brackets 33 are attached to the support column 2 at one of a plurality of vertically spaced attachment locations 35. For this purpose, the support column 2 has flanges 36, attached to the mast 27 on opposite sides thereof, with vertically spaced attachment openings 37 for securing the second support brackets 33 thereto. The second support brackets 33 have apertures 38 corresponding to the attachment openings 37 of the flanges 36. In the shown example, bolt members 39 are passed through the apertures 38 of the second support brackets 33 and through the attachment openings 37 of the flanges 36 for securing the same in the second support position.

Figure 10:
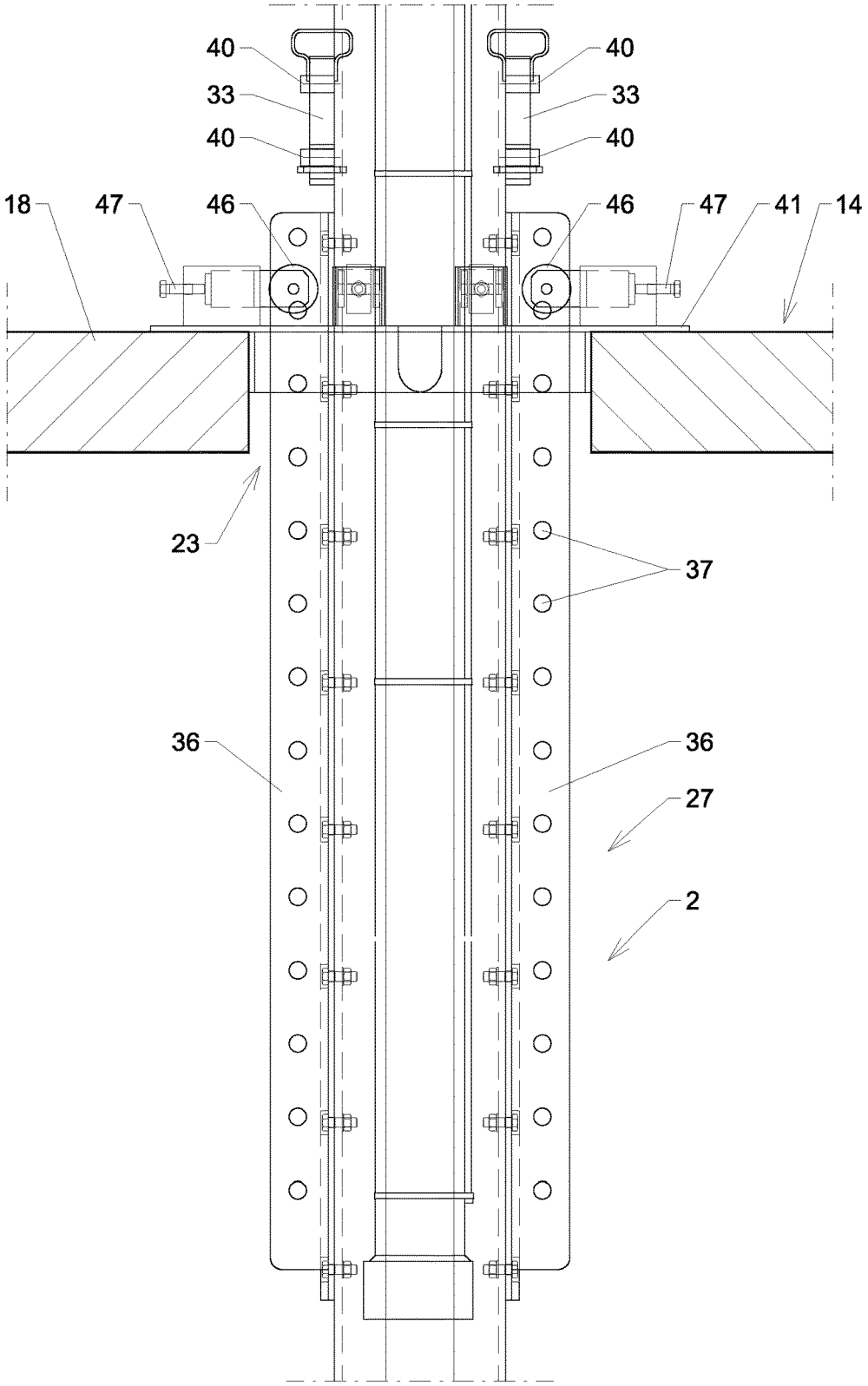
FIG. 10 is a side elevational view of a detail of the climbing formwork during repositioning (FIG. 2).
Figure 11:
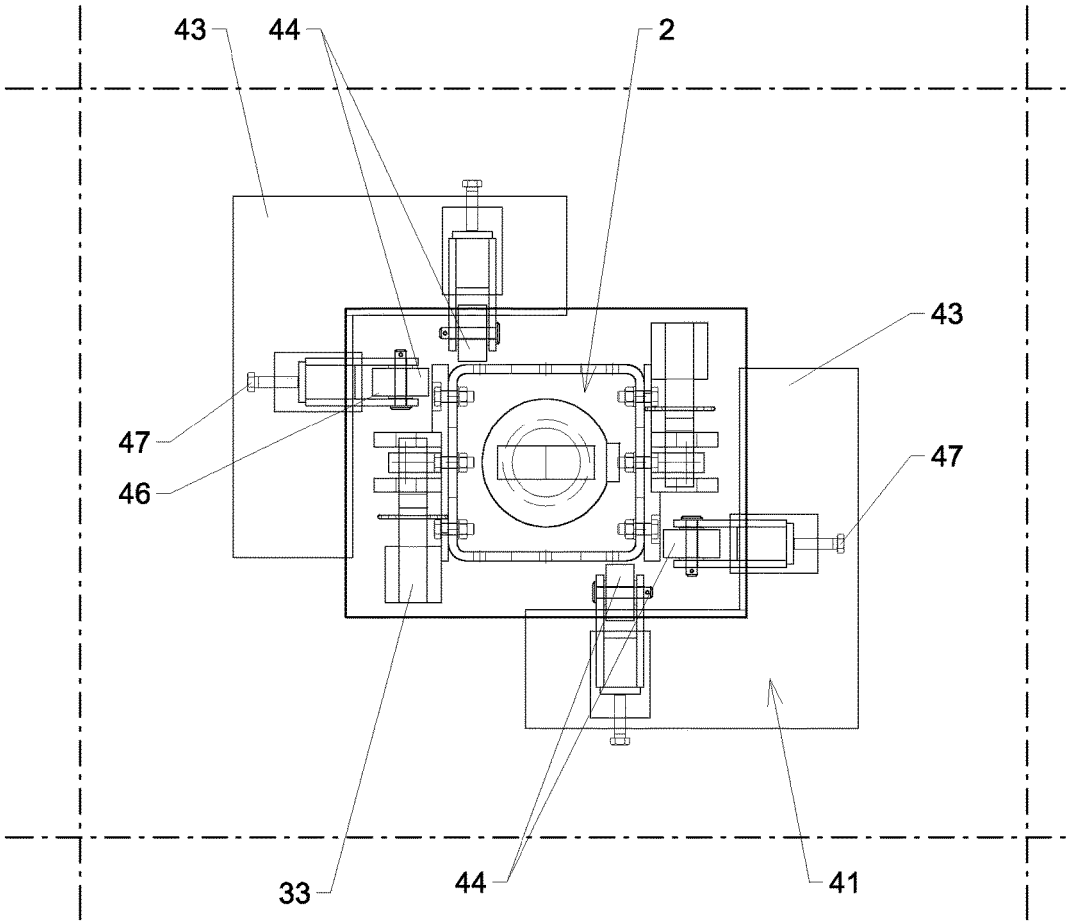
FIG. 11 is a sectional view of the detail shown in FIG. 10.

For preparing the extension of the support column 2, the second support brackets 2 are releasably attached to the support column 2 in a second transport position which is arranged for fitting the second support brackets 33 through the third through-hole 24 in the third floor slab 20 (see FIGS. 10, 11). In the shown example, the support column 2 has attachment pins 40 for connection with the apertures 38 of the second support brackets 33. The attachment pins 40 are located above the upper ends of the flanges 36. In the shown example, the second transport position of the second support brackets 33 (see FIGS. 10, 11) is perpendicular to the second support position of the second support brackets 33 (see FIGS. 8, 9).

For transferring the vertical loads from the support column 2, a first floor frame may be arranged adjacent to the first through-hole 22, a second floor frame 41 may be arranged adjacent to the second through-hole 23 and a third floor frame 42 may be arranged adjacent to the third through-hole 24. The first floor frame, second floor frame 41 and third floor frame 42 may be identical. It is possible to use the same floor frame as first floor frame, second floor frame 41 and third floor frame 42. For this purpose, the floor frame may be repositioned in the individual stages of the operation for providing support against the vertical loads from the support column 2. The first floor frame, second floor frame 41 and third floor frame 42 may be made of a metal material. In the shown example, the first floor frame, the second floor frame 41 and the third floor frame 42 each comprises two separate (i.e. individually removable) frame parts 43. The two separately removable frame parts 43 are L-shaped in top view (see FIG. 9 or FIG. 11).

Furthermore, the support column 2, while being transferred from the retracted position to the extended position or vice versa, is guided and horizontally supported. For this purpose, the first floor frame may have a first guide and support member, the second floor frame 41 may have a second guide and support member 44 and the third floor frame 42 may have a third guide and support member 45. In the shown example, said guide and support members each have at least one roll 46 for providing rolling support of the support column 2. Here, each guide and support member has four rolls 46 corresponding to the four sides of the mast 27. In the shown example, adjustment screws 47 are provided for adjusting the position of the guide and support members relative to the mast 27 of the support column 2.

FIGS. 12 to 17 show an alternative embodiment, in which first gravity pawls 48 are used as the first support brackets 32 and in which second gravity pawls 49 are used as the second support brackets 33.

Figure 12:
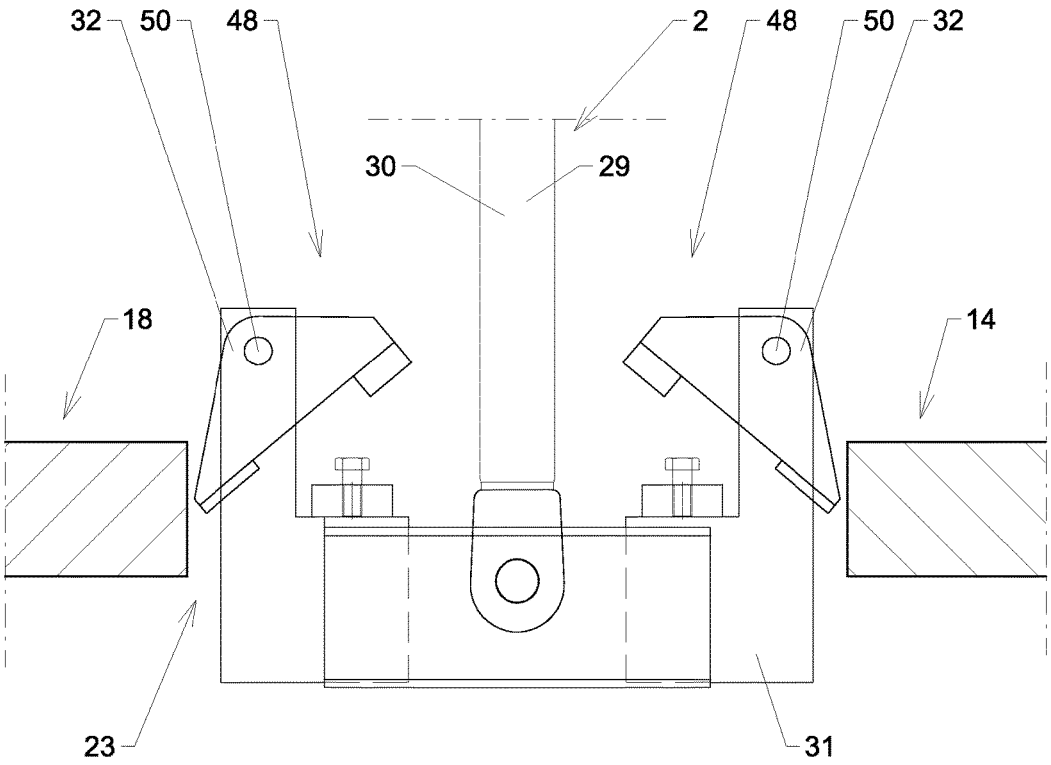
FIG. 12 is a side elevational view of a climbing formwork according to another embodiment of the disclosure with a lower gravity pawl on the lower end of the support column passing through a through-hole in one of the floor slabs of the concrete structure.
Figure 13:
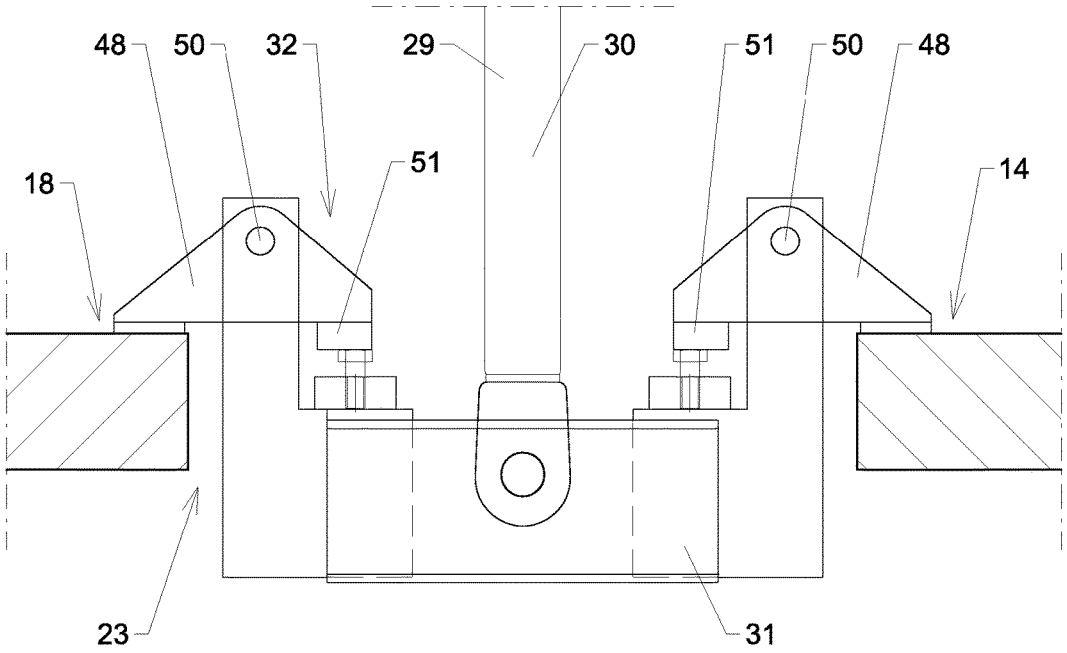
FIG. 13 is a side elevational view of the climbing formwork of FIG. 12 when the gravity pawl is supported on the floor slab adjacent to the through-hole.
Figure 14:
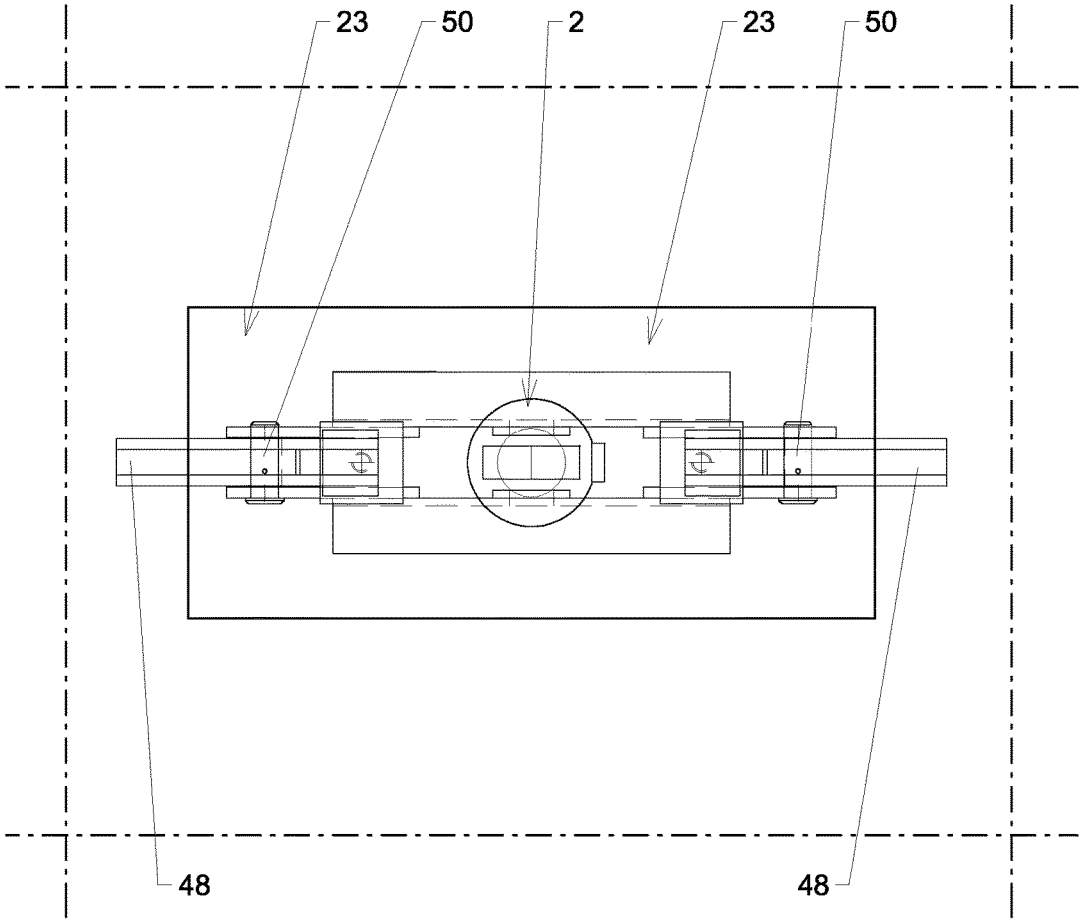
FIG. 14 is a sectional view of the climbing formwork in accordance with FIG. 13.

FIG. 12 shows the passage of the first gravity pawls 48 on the bearing 31 of the support column 2 through the second through-hole 23 formed in the second floor slab 18. In this embodiment, it is not required to manually arrange the first support bracket 32 into a transport position beforehand. The first gravity pawls 48, in contact with the second floor slab 18, are pivoted about first horizontal axes 50 such that the first gravity pawls 48 fit through the second through-hole 23 in the second floor slab 18 (see FIG. 12). After the first gravity pawls 48 on the bearing 31 have passed the second through-hole 23, the first gravity pawls 48, by force of gravity, pivot back into their normal position resting on first stops 51 on the bearing 31. The first gravity pawls 48 may then be supported on the second floor slab 18 adjacent to the second through-hole 23 (see FIG. 13).

Figure 15:
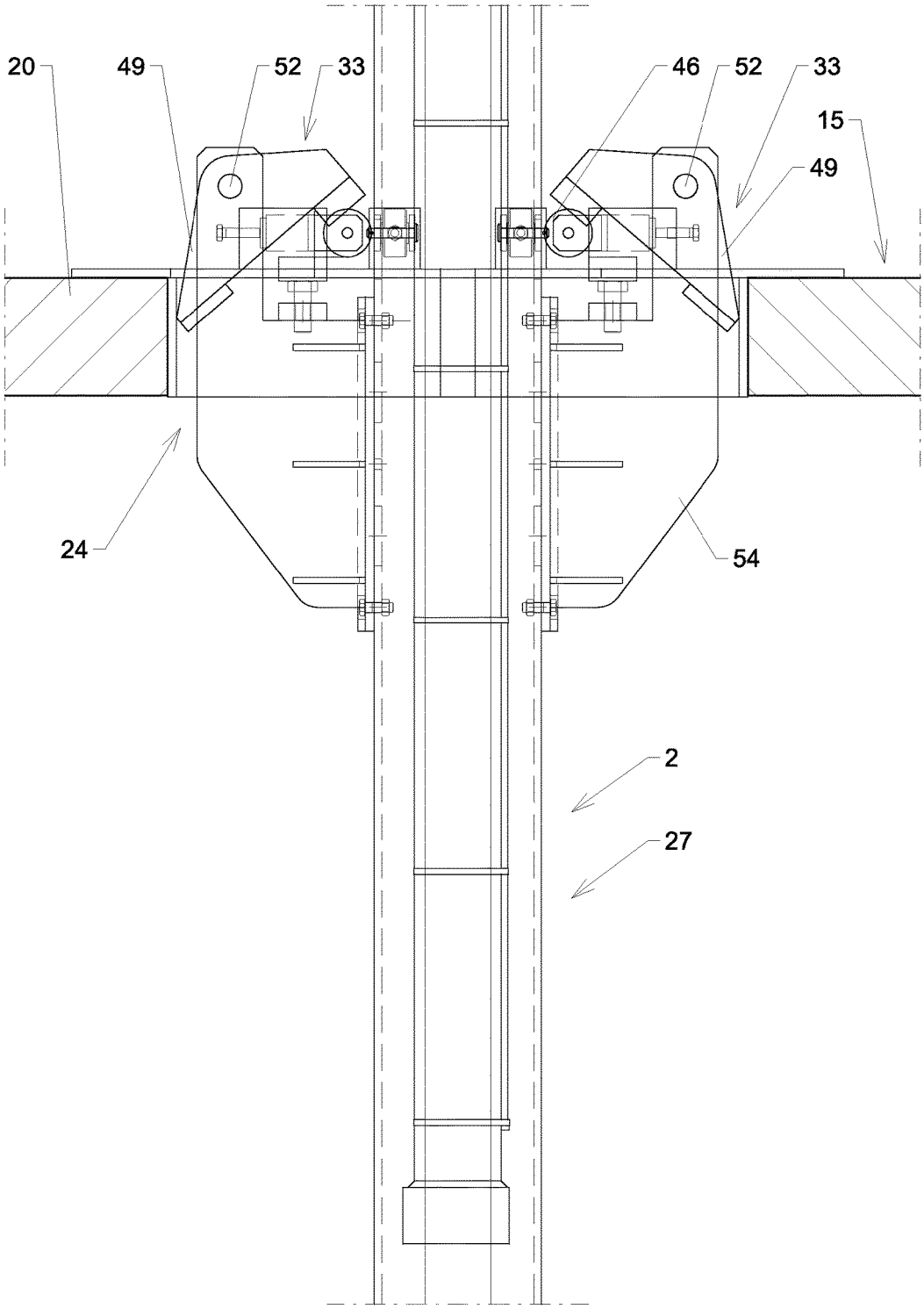
FIG. 15 is a side elevational view of the climbing formwork of FIGS. 12 to 14 with an upper gravity pawl while passing through a through-hole in one of the floor slabs.
Figure 16:
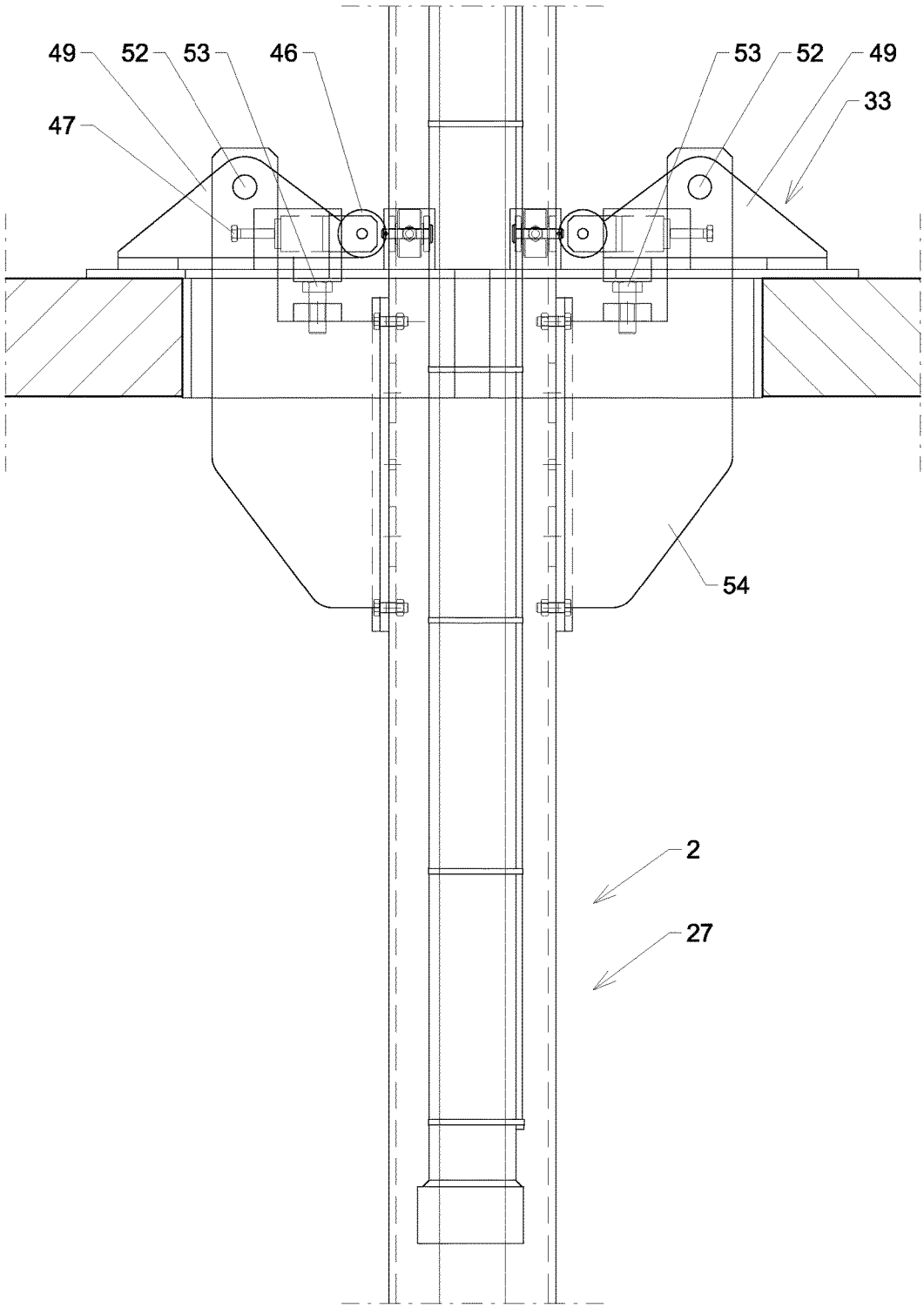
FIG. 16 is a side elevational view of the climbing formwork of FIGS. 12 to 15 when the upper gravity pawl is supported on the respective floor slab.
Figure 17:
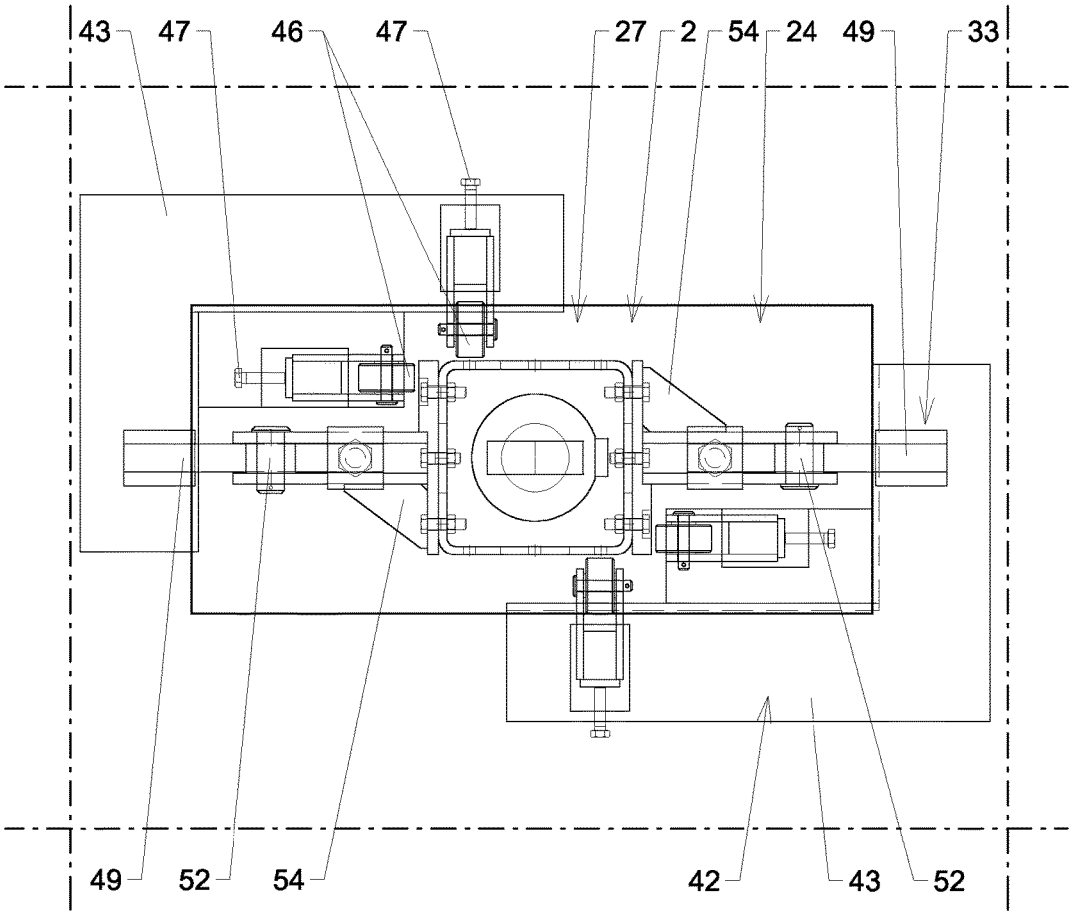
FIG. 17 is a sectional view of the climbing formwork in accordance with FIG. 16.

FIG. 15 shows the passage of the second gravity pawls 49 attached to the mast 27 of the support column 2 through the third through-hole 24 formed in the third floor slab 20. The second gravity pawls 49 have the same construction as the first gravity pawls 48. Thus, the second gravity pawls 49 may pivot sideways about second horizontal axes 52 to allow for passage through the third through-hole 24 (see FIG. 15). Under the influence of gravity, the second gravity pawls 49 then return to their horizontal normal position in abutment with second stops 53 so that the second gravity pawls 49 may be supported on the third floor slab 20 adjacent to the third through-hole 24. In the shown example, each second gravity pawl 49 is supported by a clevis 54 attached to the mast 27 to take account of the higher vertical loads received by the second gravity pawls 49 in comparison to the first gravity pawls 48.

In the second embodiment of FIGS. 12 to 17, the floor frames and the guide and support members are identical to those of the first embodiment shown in FIGS. 1 to 11.

Figure 18:
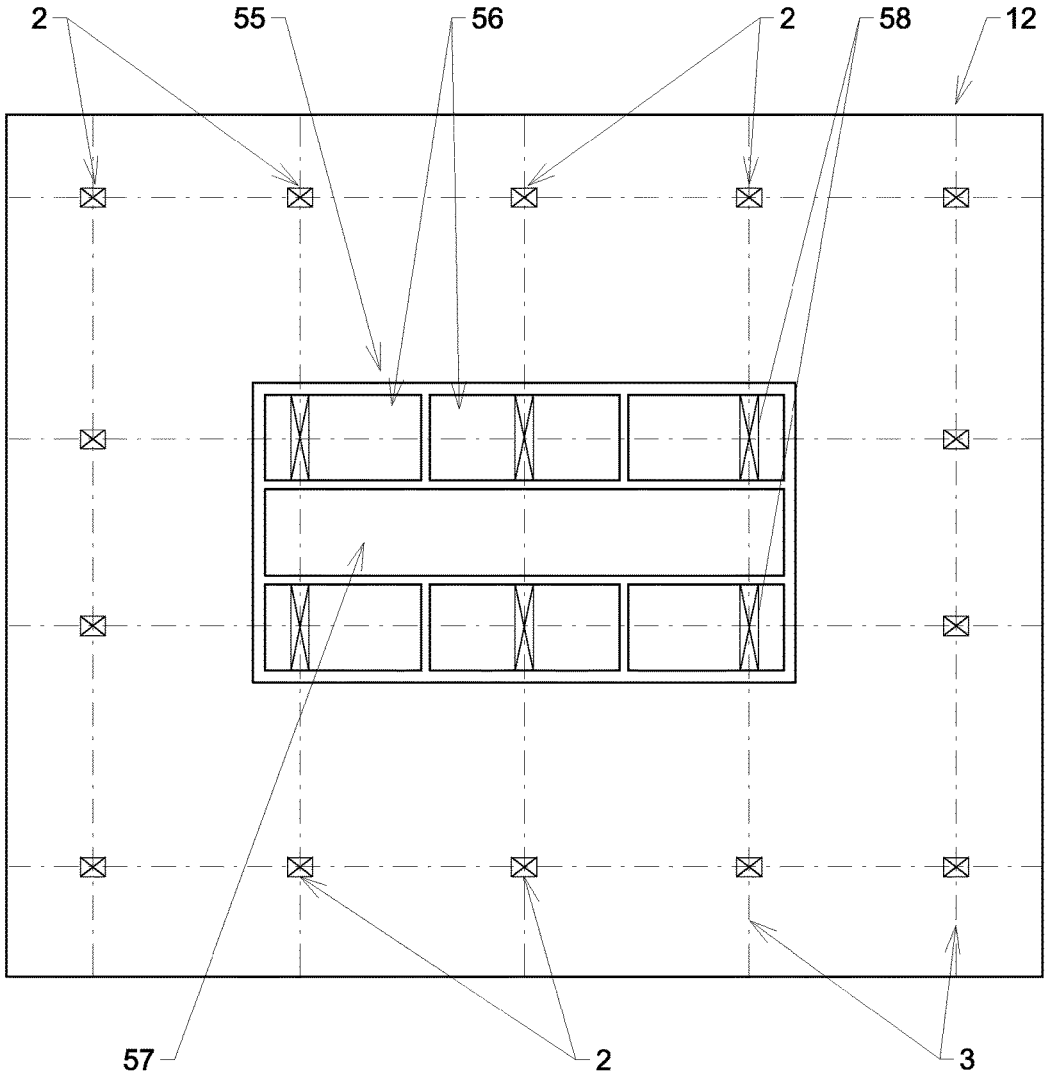
FIG. 18 is a schematic view of a first application of the climbing formwork.
Figure 19:
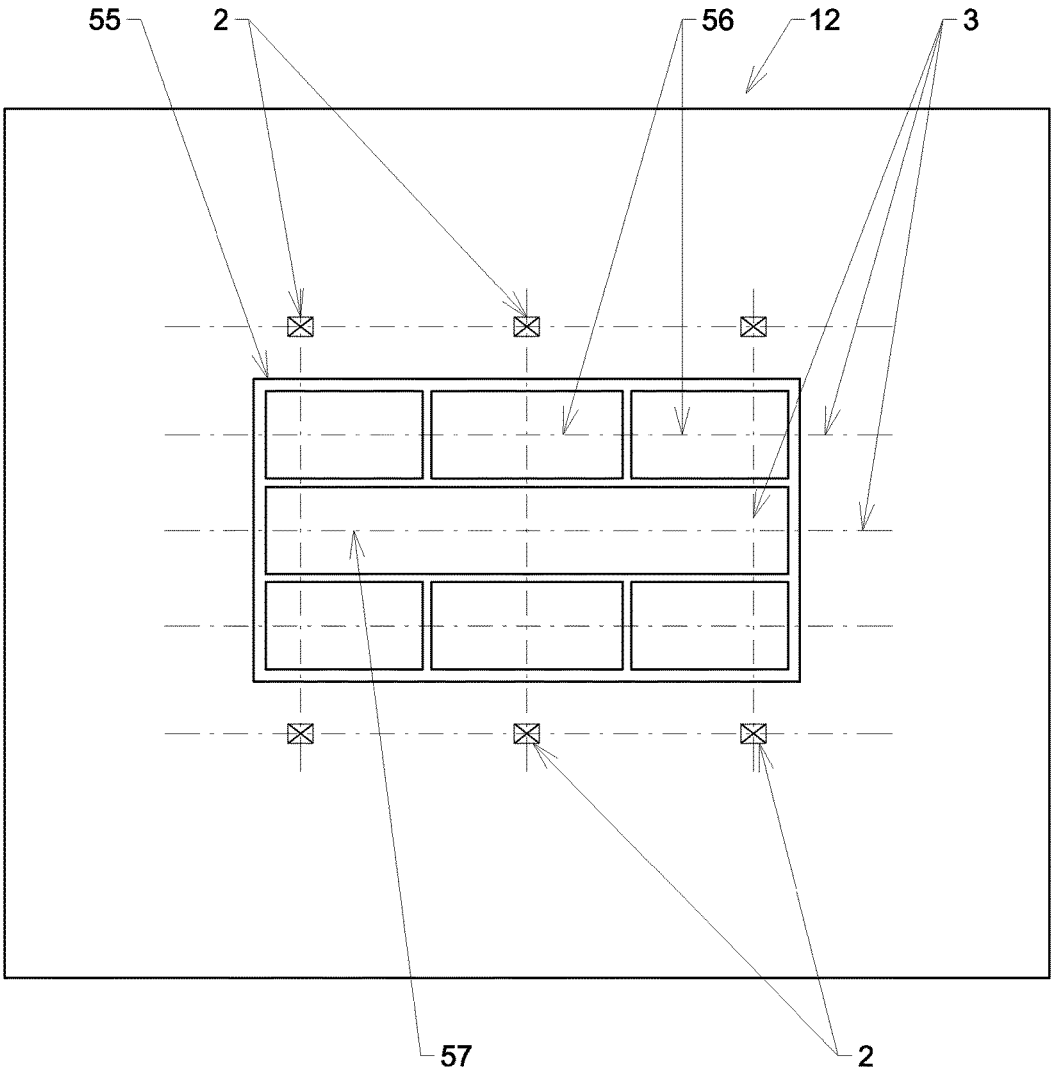
FIG. 19 is a schematic view of a second application of the climbing formwork.
Figure 20:
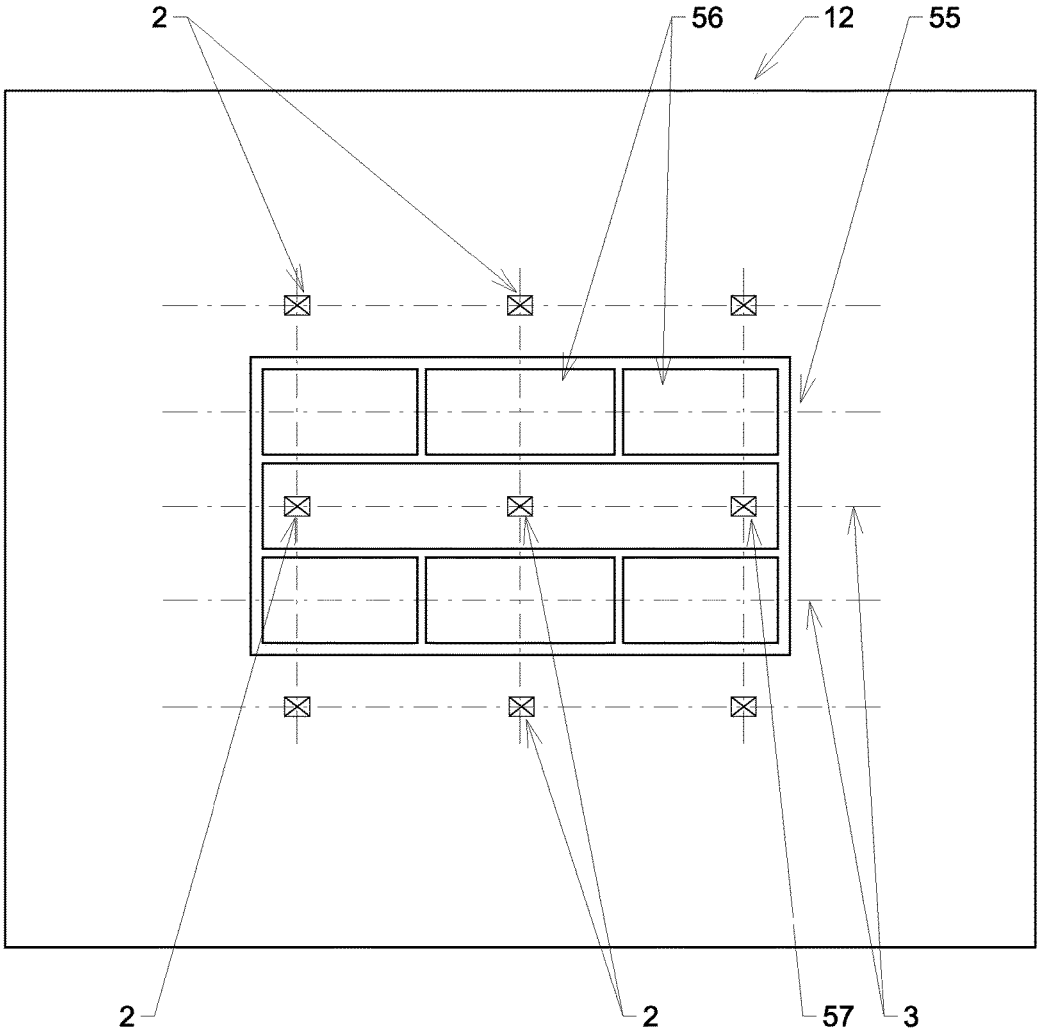
FIG. 20 is a schematic view of a third application of the climbing formwork.

In the construction of buildings 12, a plurality of support columns 2 with first and second support brackets as described above may be used for supporting the frame 3 from which the formworks 4 are suspended. In FIGS. 18 to 20, the support columns 2 and the frame 3 are illustrated schematically.

According to FIGS. 18 to 20, the building 12 as built (seen in top view) has a core 55 with, for example, two rows of shafts 56, which may be elevator shafts. Each level of the building has a floor slab 57 between the two rows of shafts 56.

In the embodiment of FIG. 18, a plurality of support columns 2 are arranged for supporting the frame 3 outside the core 55, in a peripheral region of the building 12. In this way, the frame 3 may superimpose essentially the full horizontal extension of the building 12. In this way, the entire upper floor of the building may be protected during construction. In this application, additional climbing formworks 58 may be provided in the core 55 of the building 12. For example, conventional climbing formworks with two support columns connected to one another, each of which carrying a climbing shoe may be used inside the core 55. In contrast to this, singular support columns 2 are used, which are not directly connected to one another.

In the embodiment of FIG. 19, a plurality of support columns 2 are arranged outside the core 55 for superimposing the core 55 during construction. In this example, the frame 3 for constructing the core 55 is exclusively supported by the support columns 2 outside the core 55. At least four support columns 2, for example six support columns 2, are provided for this purpose. In this way, the core 55 of the building 12 may be free from additional climbing formworks 58.

In the embodiment of FIG. 20, a plurality of support columns 2 are employed for supporting the construction of the floor slab 57 between the two rows of shafts 56 on either side of the floor slab 57. Additional support columns 2 may be arranged outside the core 55.

The invention claimed is:

1. A climbing formwork for erecting a concrete structure with a plurality of casting segments having floor slabs with through-holes formed therein, comprising:

a support column with a jack for transferring the support column between a retracted position and an extended position;

a frame connected to the support column for suspending a formwork; and a first support bracket attached to the support column, wherein the first support bracket is transferable between a first support position for being supported on one of the floor slabs and a first transport position for being passed through one of the through-holes in the floor slabs, wherein a second support bracket is attached to the support column, the second support bracket being transferable between a second support position for being supported on one of the floor slabs and a second transport position for being passed through one of the through-holes in the floor slabs, the second transport position of the second support bracket being located above the first transport position of the first support bracket and the second support position of the second support bracket being located above the first support position of the first support bracket.

2. The climbing formwork of claim 1, wherein the first support bracket in the first transport position is arranged closer to a center line of the support column than in the first support position.

3. The climbing formwork of claim 1, wherein the first support bracket, in the first support position, is releasably attached to a bearing, the bearing being connected to a lower end of the jack.

4. The climbing formwork of claim 3, wherein the first support bracket, in the first transport position, is releasably attached to the bearing.

5. The climbing formwork of claim 1, wherein the first support bracket in the first transport position is arranged upside-down with respect to the first support position.

6. The climbing formwork of claim 1, wherein the second support bracket, in the second support position, is releasably attached to the support column at one of a plurality of vertically spaced attachment locations.

7. The climbing formwork of claim 1, wherein the second support bracket, in the second support position, is releasably attached to a flange of the support column, the flange having a plurality of vertically spaced attachment openings for securing the second support bracket thereto.

8. The climbing formwork of claim 1, wherein the second transport position is perpendicular to the second support position.

9. The climbing formwork of claim 1, wherein the support column has an attachment member for securing the second support bracket in the second transport position.

10. The climbing formwork of claim 9, wherein the attachment member is an attachment pin.

11. The climbing formwork of claim 1, wherein the first support bracket and/or the second support bracket each has an upper side facing away from the underlying floor slab and a lower side facing the underlying floor slab for support thereon, wherein a radial extension of the upper side of the first and/or second support bracket is less than the radial extension of the lower side of the first or second support bracket, respectively.

12. The climbing formwork of claim 1, wherein the support column comprises a mast with an upper end carrying the frame, wherein the jack is operably connected to the mast for extending or retracting the support column.

13. A climbing formwork for erecting a concrete structure with a plurality of casting segments having floor slabs with through-holes formed therein, comprising:

a support column with a jack for transferring the support column between a retracted position and an extended position;

a frame connected to the support column for suspending a formwork;

a first support bracket attached to the support column; and a first floor frame for supporting the first support bracket on one of the floor slabs adjacent to the through-hole formed therein, wherein the first support bracket is transferable between a first support position for being supported on one of the floor slabs and a first transport position for being passed through one of the through-holes in the floor slabs, and wherein the first floor frame comprises two separate frame parts, the two separate frame parts being L-shaped in top view.

14. The climbing formwork of claim 13, wherein rolls for guiding and horizontally supporting the support column, while being transferred from the retracted position to the extended position or vice versa, are arranged on the first floor frame.

15. A climbing formwork for erecting a concrete structure with a plurality of casting segments having floor slabs with through-holes formed therein, comprising:

a support column with a jack for transferring the support column between a retracted position and an extended position;

a frame connected to the support column for suspending a formwork; and a first support bracket attached to the support column, wherein the first support bracket comprises a first gravity pawl arranged for being passed through one of the through-holes in the floor slabs and for being supported on the respective floor slab adjacent to the through-hole; and wherein the first gravity pawl is pivotable between a normal position for support on an underlying floor slab of the floor slabs and a temporary position for transport through the through-hole of an overlying floor slab of the floor slabs, wherein the first gravity pawl, by force of gravity, pivots back into its normal position from the temporary position after having passed through the through-hole of the overlying floor slab.

16. The climbing formwork of claim 15, wherein a second support bracket is attached to the support column, the second support bracket being transferable between a second support position for being supported on one of the floor slabs and a second transport position for being passed through one of the through-holes in the floor slabs, the second transport position of the second support bracket being located above the first transport position of the first support bracket and the second support position of the second support bracket being located above the first support position of the first support bracket.

17. The climbing formwork of claim 16, wherein the second support bracket comprises a second gravity pawl.

* * * * *